US007462100B2

(12) United States Patent
VanWormer

(10) Patent No.: US 7,462,100 B2
(45) Date of Patent: Dec. 9, 2008

(54) FIRE DAMPER ASSEMBLY

(75) Inventor: Norman C. VanWormer, Bay City, MI (US)

(73) Assignee: Globe Technologies Corporation, Standish, MI (US)

( * ) Notice: Subject to any disclaimer, the term of this patent is extended or adjusted under 35 U.S.C. 154(b) by 0 days.

(21) Appl. No.: 11/786,186

(22) Filed: Apr. 11, 2007

(65) Prior Publication Data

US 2008/0254736 A1 Oct. 16, 2008

(51) Int. Cl.
*A62C 2/16* (2006.01)
*A62C 2/06* (2006.01)
*F24F 13/08* (2006.01)

(52) U.S. Cl. ..... 454/369; 454/257; 454/357; 126/287.5

(58) Field of Classification Search ..... 454/257, 454/357, 369; 126/287.5; 169/42; 24/265 H, 24/599.1

See application file for complete search history.

(56) References Cited

U.S. PATENT DOCUMENTS

| | | | | |
|---|---|---|---|---|
| 77,068 | A | 4/1868 | McNeill | |
| 357,148 | A * | 2/1887 | Hall | 169/42 |
| 2,451,591 | A | 10/1948 | Tinnerman et al. | |
| 2,986,792 | A | 6/1961 | Wyatt | |
| 3,024,509 | A | 3/1962 | Hamann | |
| 3,467,163 | A | 9/1969 | Vassaux | |
| 3,485,284 | A | 12/1969 | Turner et al. | |
| 3,687,185 | A * | 8/1972 | Singer | 160/1 |
| 3,796,246 | A | 3/1974 | Walenta | |
| 3,826,223 | A * | 7/1974 | Lingo, Jr. | 116/174 |
| 4,333,392 | A * | 6/1982 | Nailor et al. | 454/369 |
| 4,520,537 | A | 6/1985 | Valikov | |
| 4,667,910 | A | 5/1987 | Atterby et al. | |
| 4,763,711 | A | 8/1988 | Hart et al. | |
| 4,795,353 | A | 1/1989 | Baker | |
| 5,120,152 | A * | 6/1992 | Gueli | 403/179 |
| 5,231,740 | A | 8/1993 | Mohebkhosravi | |
| 5,241,727 | A | 9/1993 | Lee | |
| 5,267,125 | A | 11/1993 | Liu | |

(Continued)

FOREIGN PATENT DOCUMENTS

| | | |
|---|---|---|
| GB | 2028128 | 3/1980 |

(Continued)

*Primary Examiner*—Steven B McAllister
*Assistant Examiner*—Patrick F. O'Reilly, III
(74) *Attorney, Agent, or Firm*—John K. McCulloch

(57) ABSTRACT

A fire damper assembly has a damper mounted in an air duct for movements between an open, air passing position in which the damper enables air to flow through the duct and a closed position in which the damper blocks the passage of air through the duct. A strut composed of joined but separable components normally underlies the damper and supports the latter in the open position. The strut may be moved from its damper engaging position to a damper-free position while the separable components remain joined. At least one end of the strut is pivotally connected to a support arm for swinging movements of the strut between damper engaging and damper-free positions and may have its opposite end manually detached from the second support arm, thereby enabling the damper to swing to its closed position. The respective support arms are removably maintained in strut-supporting position by releasable latches which enable a tactile sensing of their positions.

4 Claims, 3 Drawing Sheets

U.S. PATENT DOCUMENTS

| | | | | |
|---|---|---|---|---|
| 5,272,795 | A | 12/1993 | Rothstein | |
| 5,309,616 | A | 5/1994 | Sobin | |
| 5,819,380 | A | 10/1998 | Paolercio et al. | |
| 6,318,399 | B1 * | 11/2001 | Backham et al. | 137/79 |

FOREIGN PATENT DOCUMENTS

| | | |
|---|---|---|
| GB | 2150829 | 7/1985 |
| GB | 2180745 | 4/1987 |
| GB | 2249479 | 5/1992 |
| JP | 08-308949 | 11/1996 |
| JP | 2002-200186 | 7/2002 |

* cited by examiner

FIG - 6
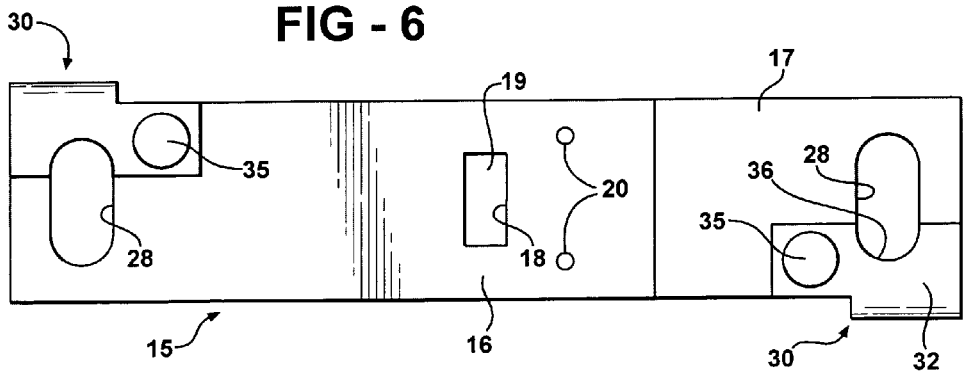
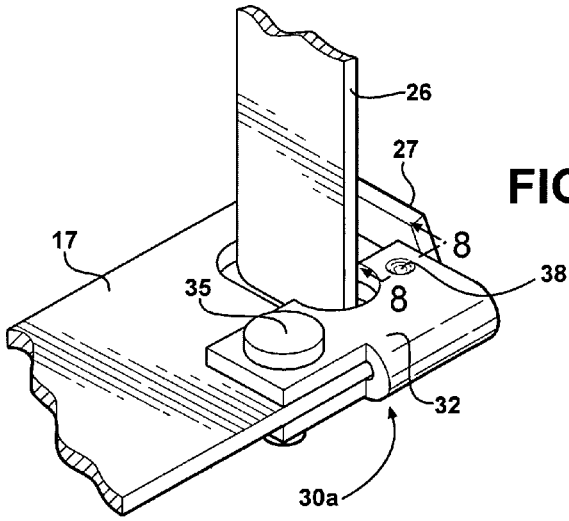
FIG - 7
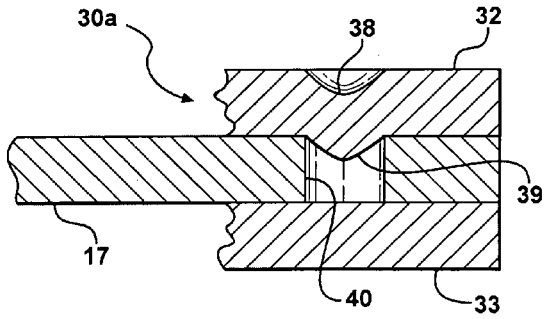
FIG - 8

FIRE DAMPER ASSEMBLY

This disclosure relates to a fire damper assembly of the kind installed in an air duct for movement of a damper from an open, air-passing position to a closed, air-blocking position in response to a predetermined rise in ambient temperature.

BACKGROUND OF THE APPARATUS

It is common practice to provide in a commercial building air ducts through which air may flow from a furnace, boiler, air conditioner, and the like to one or more areas in the building. It also is common practice to install in one or more of such ducts a damper which normally is in an open or retracted position enabling air flow through the duct. However, when ambient temperature rises as a result of a fire or over-heated condition a fusible link assembly responds to a predetermined increase in ambient temperature and enables the associated damper to move from its air-passing position to its air-blocking position, thereby minimizing the supply of air to the affected area.

Most state and municipal codes require the fire dampers to be tested periodically to ensure their operability. Many fire dampers are of the kind wherein the damper is supported in its air-passing position by a collapsible strut composed of separable fusible links. Testing of such a damper assembly requires relocating of the fusible strut from its damper-supporting position to a position free of the damper, thereby enabling the latter to move to its air-blocking position. Following the test, the damper is returned manually to its retracted, air-passing position and the fusible strut is manually returned to its damper-engaging position.

The dampers are installed in strategic positions within the ducts and each duct within which a damper is installed has an access or inspection opening by means of which a technician may gain access to the damper for cycling it between its air passing and air-blocking positions. However, these openings usually are fairly small in area so as to avoid the creation of air leaks. As a consequence, access to the fusible strut and damper is quite limited, thereby making it difficult for the damper to be tested and reset properly. In addition, the access to the damper assembly often is obstructed by the presence of pipes, ducts, cables, and the like which are adjacent or within the air duct. Consequently, visual inspection and manual actuation of the damper assembly are hampered.

A principal objective of the apparatus disclosed herein is to provide a damper and collapsible support assembly which is easily operable for test purposes and manually resettable even though visual and manual access to the damper assembly is less than ideal. Another objective is to provide tactile evidence that the support assembly is returned to its proper position following testing.

SUMMARY OF THE DISCLOSURE

A fire damper assembly as disclosed herein comprises a frame which spans an air duct and mounts a damper which is movable from a normal, open or retracted position in which the flow of air through the duct is unimpeded to an extended, closed position in response to an increase in ambient temperature so as to obstruct or block the flow of air through the duct. The damper may be gravity or spring biased from its retracted position to its extended position and maintained in its retracted position by a collapsible strut including one or more fusible links which are joined by a eutectic substance which liquefies at a predetermined temperature.

The strut is suspended at its opposite ends by means of a pair of hanger or support arms connected to the frame in a position to underlie and support the damper. At least one end of the strut is removably connected to its associated support arm so as easily to be disconnected therefrom. The opposite end of the strut is swingable relative to its support arm so that, when the one end of the strut is disconnected from its support arm, the strut will swing by gravity to a position free of the damper, thereby enabling the latter to move from its air-passing to its air-blocking position.

Following testing of the damper assembly the damper may be returned manually to its air-passing position and the strut returned manually to its damper-supporting position and reconnected to the frame via the support arm. The connection between the strut and the frame is one that can be manipulated manually and provide tactile confirmation of a proper reconnection without having to be seen by the operating technician.

THE DRAWINGS

The presently preferred embodiment of the invention is illustrated in the accompanying drawings wherein:

FIG. 6 is a top plan view of the strut in its assembled condition;

FIG. 7 is a fragmentary view similar to FIG. 4 but illustrating a modification; and FIG. 8 is an enlarged sectional view taken on the line 8-8 of FIG. 7.

THE PREFERRED EMBODIMENTS

Figure 2:
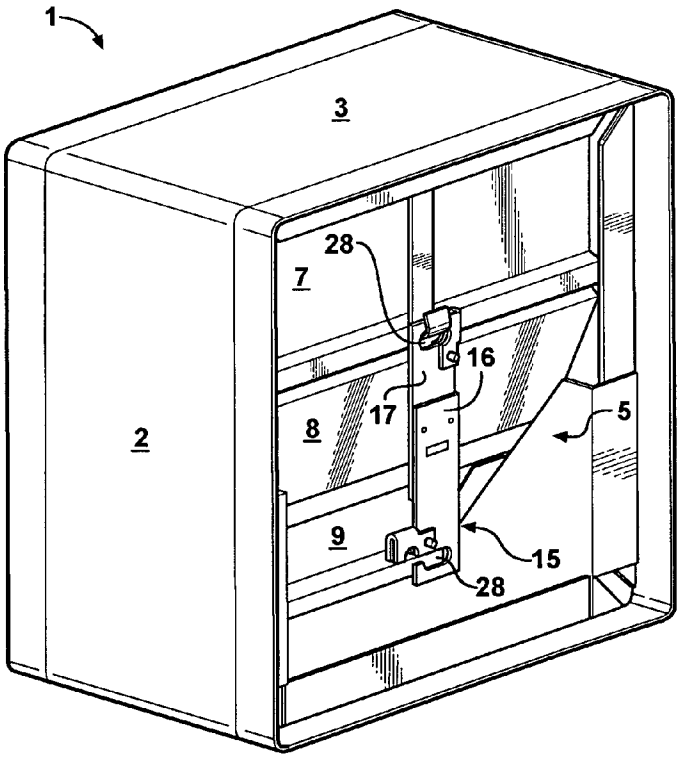
FIG. 2 is a view similar to FIG. 1 but illustrating the strut free of the damper and the latter in its extended, air-blocking position.

Apparatus constructed in accordance with the disclosed embodiments includes a frame 1 which may comprise part of an air duct or a separate frame accommodated within and fixed to such duct. In either event, the frame has opposed side walls 2 joined by top and bottom walls 3. Within the frame is an open sided, open bottom housing 4 within which is mounted an extendible and retractable damper 5 of known construction. The damper has a plurality of pivoted leaves including an anchor leaf 6 fixed to the top wall of the housing 4 and pivotally coupled to leaves 7, 8, and 9 which, in the retracted position shown in FIG. 1 occupy a folded condition which enables air to move through the duct past the damper. A coilable spring blade 10 is secured at one end 11 to the damper leaf 9 and has its other end secured to a spindle (not shown) mounted within a housing for rotation. The spindle is connected to a torsion spring (not shown) which urges the spindle to rotate in such direction as to cause the blade 10 to be wound about the spindle within the housing.

Figure 1:
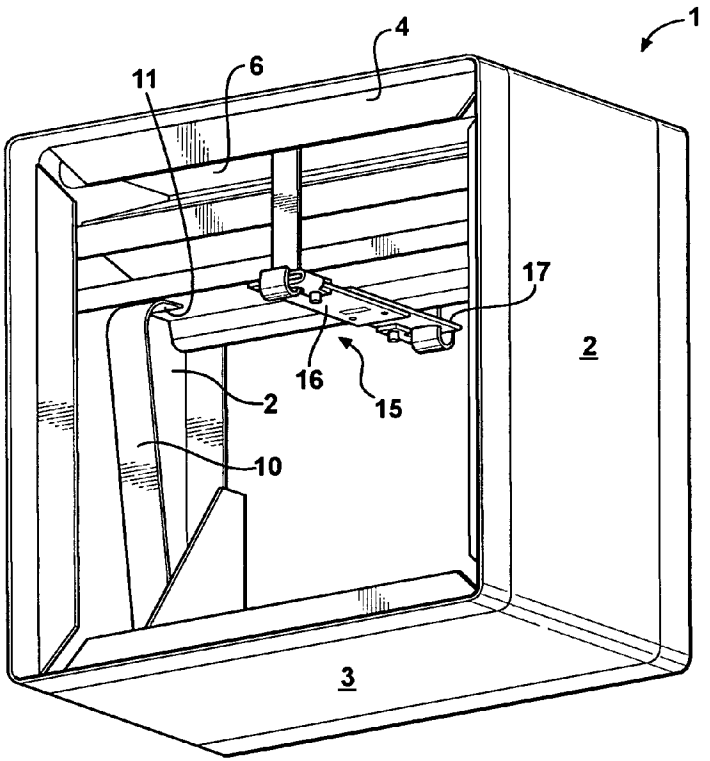
FIG. 1 is an isometric view of a damper-accommodating frame within which is a damper supported in a retracted, air-passing position by a collapsible strut.
Figure 3:
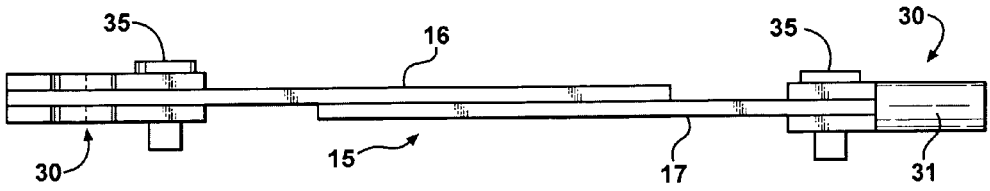
FIG. 3 is a side elevational view of the collapsible strut in its assembled condition.
Figure 4:
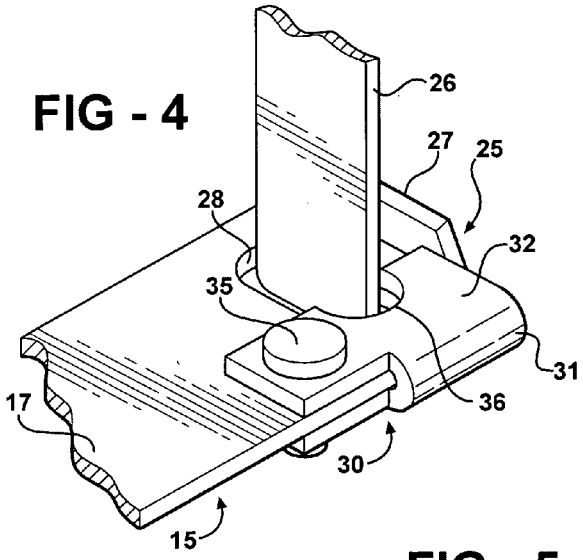
FIG. 4 is a fragmentary, isometric view illustrating one end of the strut in latched condition with a strut support arm.
Figure 5:
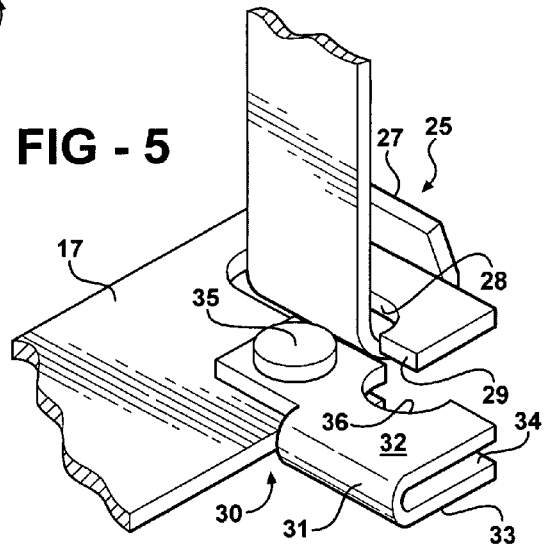
FIG. 5 is a view similar to FIG. 4 but illustrating the latch in its open condition.

The spring blade 10 constantly biases the damper to move from its air-passing, retracted position shown in FIG. 1 to an extended, air-blocking position shown in FIG. 2. The damper could be gravity biased, if desired, but for assured operability the damper preferably is spring biased to its extended position.

The apparatus thus far described is conventional and forms no part of the invention apart from its cooperative relationship with the apparatus subsequently described herein.

The apparatus includes a collapsible strut 15 of known construction which, in one position, underlies and engages the lower leaf 9 of the damper and supports the damper in its retracted position until such time as it is desired to enable the damper to move from its retracted position to its extended position. The strut comprises a pair of separate, overlying components or links 16 and 17 which partially overlap one another. The link 16 has an opening 18 in which a positioning projection 19 removably is accommodated while the links are in assembled condition. Dimples 20 and small projections on the links 16 and 17 also are engaged to assist in the proper alignment of the links during assembly thereof.

Interposed between the overlapping portions of the links 16 and 17 is a known eutectic material (not shown) which, under normal ambient temperature conditions, is solid and secures the two links to one another. However, in response to an increase in ambient temperature to a predetermined level the eutectic material will liquefy and enable the two links 16 and 17 to separate from one another, thereby enabling the strut 15 to collapse. The construction and operation of the links 16 and 17 and the eutectic material are well known and conventional. Such links and material are commercially available from Globe Technologies Corporation, Standish, Mich.

Support means 25 is provided at least at one end, and preferably both ends, of the strut 15 for removably connecting the strut to the frame via the housing 4 and in a position to underlie and support the damper. Each support means comprises a strap or arm 26 having its upper end secured to the top of the housing and extending vertically downwardly therefrom. The lower end of each arm 26 has a loop 27 which extends through a slot 28 at the adjacent end of a link.

Each slot 28 has a length and width of such size as freely to accommodate the associated support arm 26. To avoid having to unroll the loop 27 each link has a lateral passageway 29 in communication with the associated slot 28, thereby enabling the loop to pass into and out of the slot. To ensure retention of the loop in its associated slot a latch 30 is provided to effect closing and opening of the passageway.

Each latch comprises a keeper or body 31 having upper and lower flanges 32 and 33 spaced by a gap 34 of such thickness as easily to accommodate the thickness of the link. The body is pivoted to the link by a pin 35 and the flanges 32 and 33 are cut away to provide recesses 36 for the accommodation of a part of the support arm loop 27. Pivotal movements of the body 31 enable the passageway 29 to be opened or closed. The latch 30 shown in FIGS. 1-6 differs from the latch 30*a* shown in FIGS. 7 and 8 in that the latch 30*a* has a dimple 38 in one flange which forms a blunt projection 39 that is movable into and out of a detent opening 40 in response to movements of the latch body between its open and closed positions. The thickness of the flanges is such as to enable appropriate deflection of the upper flange and removal of the projection 39 from the opening 40 in response to pivotal movement of the latch. Either or both ends of the strut may be separated from the respective support arms. If only one end of the strut is separated, the strut may swing from its damper engaging and supporting position to a vertical position, as shown in FIG. 2, in which the strut is disengaged from the damper. Disengagement of the strut from the damper enables the latter to move from its upper or retracted position to its extended position in which it blocks the flow of air past the damper.

The disconnection of one of the ends of the strut from the associated support arm 26 may be accomplished manually by a technician's simply swinging one of the latches in a direction to open the associated passageway. No bending or other adjustment of any part of the strut connecting means is required.

To restore the damper to its retracted position the extended damper leaves may be moved manually upwardly and held in such position while the strut is rocked from its vertical position to a substantially horizontal position in which the associated passageway 29 is open, thereby enabling the loop 27 at the lower end of the support arm 26 to enter the slot 28, whereupon the latch may be moved to its closed position. Again, this operation may be performed manually without the technician's having to view the component parts of the assembly and without having to bend, thread, or otherwise adjust the parts of the assembly. The simplicity of the connection and disconnection of the supporting strut to the damper mounting frame is such that testing the operability of the damper is neither awkward nor burdensome.

When the embodiment of FIGS. 7 and 8 is used, full closing of the latch will be accompanied by the snapping of one projection 39 into the opening 40, thereby providing a tactile indication of the secure positioning of the latch.

As is shown in FIGS. 1, 2, and 6, there is a loop-accommodating slot 28 at each end of the strut 15. In these figures the slots and their associated latches are at opposite sides of the strut. However, such slots and latches may be at the same side of the strut if such positioning makes more convenient the opening and closing of either of the latches.

This disclosure is representative of presently preferred embodiments of the invention, but is intended to be illustrative rather than definitive thereof. The invention is defined in the claims.

I claim:

1. A fire damper assembly comprising a frame; a damper mounted on said frame for movements between a first position and a second position; means biasing said damper toward said second position; a support strut having opposite ends each of which has a slot therein and being formed of separable components joined by a eutectic substance which liquefies and releases said components in response to an increase in ambient temperature to a predetermined level; mounting means mounting said strut in a position underlying said damper for supporting said damper in said first position when said ambient temperature is at a level lower than that of said predetermined level, said mounting means comprising a pair of support arms each having opposite ends one of which is connected to and depends from said frame and the other of which passes through one of the slots in said strut and is looped to overlie that end of said strut through which said one of said slots extends thereby forming at each end of said strut an axis of rotation for said strut each of said slots being in communication with a passageway adjacent each end of said strut, each said passageway enabling the support arm extending through an adjacent one of said slots to pass out of said adjacent slot via said passageway thereby enabling said strut to be released from said one of said support arms, whereupon said strut is enabled to rotate about said axis at that end of said strut remote from said adjacent slot; and latch means at each end of said strut operable selectively to open and close the passageway at the corresponding end of said strut and thereby disable and enable movement of said selected support arm through that passageway at said corresponding end of said strut.

2. The assembly according to claim 1 wherein each said passageway has a width narrower than that of the slot with which each said passageway communicates.

3. The assembly according to claim 1 including releasable detent means on each said latch means and said strut for releasably maintaining said latch means in that position in which said adjacent passageway is closed.

4. The assembly according to claim 3 wherein said detent means includes means to provide a tactile indication in response to movement of said latch means to that position in which said adjacent passageway is closed.

* * * * *